United States Patent [19]

Micallef

[11] 4,248,017

[45] Feb. 3, 1981

[54] REMOVABLE STRETCH GASKET FOR OVEN DOOR

[75] Inventor: Alfred M. Micallef, Fort Worth, Tex.

[73] Assignee: Jamak, Inc., Weatherford, Tex.

[21] Appl. No.: 970,545

[22] Filed: Dec. 18, 1978

[51] Int. Cl.[1] ..... E06B 7/16

[52] U.S. Cl. ..... 49/493; 49/475; 126/190; 403/267

[58] Field of Search ..... 49/475, 479, 485, 482, 49/493; 126/190; 403/266–268

[56] References Cited

U.S. PATENT DOCUMENTS

| | | | |
|---|---|---|---|
| 3,083,797 | 4/1963 | Wergin | 403/267 X |
| 3,404,675 | 10/1968 | Panne | 126/190 |
| 3,765,400 | 10/1973 | Meier et al. | 49/189 |
| 3,810,483 | 5/1974 | Vonderhaar | 49/482 |

*Primary Examiner*—Kenneth Downey

*Attorney, Agent, or Firm*—Silverman, Cass & Singer, Ltd.

[57] ABSTRACT

An oven door stretch gasket which comprises an extruded length of silicone rubber having a relatively short hooked metal insert adhered to the interior of the ends thereof. The insert is adhered by means of room temperature vulcanizing silicone rubber cement. The hook ends are adapted to be engaged in apertures which are provided at the corners of an oven chamber in a stretching action, the openings being spaced apart somewhat more than the unstretched distance between the hook ends. To install or remove the gasket it must be stretched.

The invention herein is concerned with a structure which will provide a more tenacious adherence between the insert and the length of gasket.

14 Claims, 10 Drawing Figures

REMOVABLE STRETCH GASKET FOR OVEN DOOR

CROSS REFERENCE TO OTHER PATENTS

U.S. Pat. Nos. 3,765,400 and 3,847,199 are incorporated herein by reference for the disclosure thereof.

BACKGROUND OF THE INVENTION

The field of the invention comprises stretch gaskets for oven doors and the background and advantages represented by the stretch gasket generally over prior gaskets used for oven doors are laid out fairly well in the incorporated patents.

The problem which is solved by the invention herein is one which has arisen for several reasons and it is concerned with the bond which is effected between the metal insert of the gasket and the tubular interior thereof.

The efficacy of the basic concept of cementing a metal insert into an end of a hollow silicone rubber gasket is beyond argument inasmuch as such gaskets, commonly called stretch gaskets, are in universal use at the present time. Where conditions are normal an excellent bond is produced by the usual method of installation and the ordinary type of insert. The usual method of installation consists of injecting a quantity of RTV cement into the hollow gasket ends and or dipping the insert into RTV and thereafter pushing the insert into the gasket end and setting the gasket aside to self-vulcanize.

As a result of variations in dimentions, silicone rubber composition, ambient termperature and humidity conditions, and the technique of the worker, the bond which is achieved may be of variable strength. The usual insert is about one quarter inch wide and of sheet steel about 1/32 inch thick and has about one and three quarters of an inch engaged within the end of the gasket. A properly installed insert will have a pull-out strength of 12 to 15 pounds. Even lesser pull-out strengths are usable without difficulty, but the gasket installers at the oven factory and the householders exert different degrees of pull on the gaskets during their installation and removal from the oven face. When the pull-out strength drops substantially below the values given above, the possibility of separating the RTV bond of the steel insert from the silicone rubber gasket interior increases.

One factor which it is felt may contribute materially to this is that the insert fits in the gasket end closely and the act of insertion during manufacture will wipe the adhesive from the surface of the insert providing little or no adhesive to establish the bond.

According to the invention, by a modification of the structure of the insert the establishment of an adhesive bond is ensured and the pull-out strength increased very substantially over the pull-out strength of prior stretch gaskets. The possibility of faulty stretch gaskets with low pull-out strength being made is materially decreased.

In the practice of the invention herein, the insert is provided with notches alongside of its edges, giving rise to wings or teeth between the notches but according to the invention herein, such teeth are rounded and not sharp or pointed in any way. The purpose thereof is not to dig or cut into the walls of the gasket body but to provide the separation between the notches and to fill out the space transversely of the tubular socket so that the insert is firmly placed in the gasket. It differs in this respect from the structure of U.S. Pat. No. 3,404,675 and one of the embodiments of U.S. Pat. No. 3,765,400 both of which disclose the use of barbs alongside the edges of the insert. These latter structures are not satisfactory because they tend to pierce the gasket and render the same useless.

SUMMARY OF THE INVENTION

Stretch gasket for use with an oven for insulating the oven cooking chamber from the exterior when the oven door is closed onto the chamber, the oven face adjacent the chamber opening having perforations at the corners thereof to receive the hook ends of the stretch gasket.

The gasket is an elastomeric extruded member having hollow sockets in the ends thereof, there being metal hooked end inserts adhered on the interior of the sockets with RTV cement. The inserts are of sheet metal and have notches in opposite edges for capturing the RTV and promoting the formation of bonds to retain the inserts in place. These notches are separated by rounded end teeth or wings that are preferably canted toward the entrance of the socket. Channels formed in one or more surfaces of the inserts guide the liquid RTV cement to flow to the notches when the insert is installed during the manufacture of the gasket.

DESCRIPTION OF THE PREFERRED EMBODIMENTS

Figure 1:
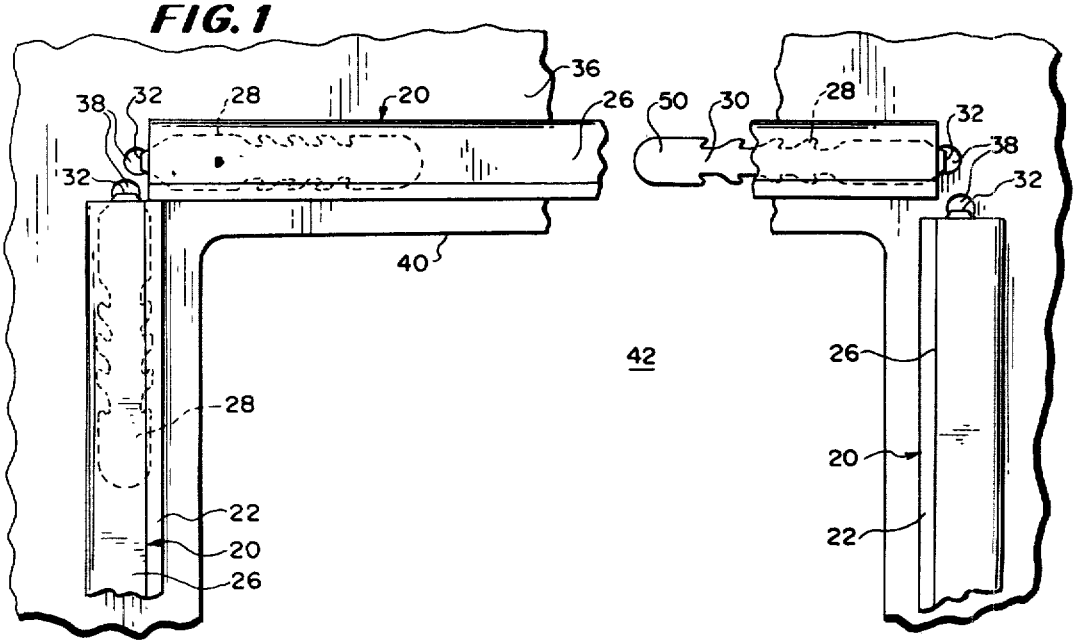
FIG. 1 is a fragmentary face-on view with portions broken away showing the stretch gasket of the invention installed in the face of an oven adjacent the entrance to the oven chamber.

The invention is concerned with increasing the RTV cement bond which is achieved in a stretch gasket between the insert and the tubular interior of the gasket over that which has been effected in commerical stretch gaskets as known. This is accomplished by a novel construction of the metal insert. Two different means are used to accomplish this, either of which or both can be used to obtain the desired end. The pull-out strength, that is, the total tension necessary to pull the insert free from its bond within the stretch gasket has been in most cases doubled through the use of these means.

In FIGS. 1 to 5 there are illustrated stretch gaskets 20 of a relatively simple design which utilize the invention. Each gasket 20 comprises a length of elastomeric material such as silicone rubber of a durometer which is readily capable of being stretched at least about 10% and returning to its original length. This is in the form of a tubular member 22 of rectangular cross section that has a hollow socket or chamber 24 formed on the interior thereof at each end. While the gasket 20 may be made of molded rubber or other elastomeric material, it is more convenient and economical to make the same as an extrusion which can be cut to length so that the chamber 24 will extend throughout its complete length. This makes the gasket somewhat more flexible than if the interior thereof were solid.

The gasket 20 has a free lateral flap 26 which is arranged to extend obliquely from the gasket 20 during use so that it may cooperate with the oven door which is closed upon the same to form a good seal. This is explained and illustrated in the referenced patents.

A sheet metal insert 28 is engaged in the socket 24 of each end of the gasket 20 and is permanently adhered in place by means of room temperature vulcanizing cement which is compatible with the type of elastomer from which the body member 22 of the gasket 20 is made. There are many such commercially available cements which are referred to as RTV.

Each of the sheet metal inserts 28 has a body 30 and a hooked end 32 which extends out of the end of the gasket 20. The hooked portion is directed laterally of the gasket in a direction opposite the direction toward which the flap 26 is directed so that when installed the flap will be free. Installation of the inserts 28 into the gasket sockets 24 is effected either by the method which is described in the referenced patents or by injecting a charge of RTV cement into the socket 24 of each gasket end and pushing the body 30 of the inserts 28 into each socket the desired depth. The gasket is then set aside to enable the cement to cure. Alternatively or in addition, the insert body 30 may be dipped in the liquid RTV cement before it is inserted into the socket 24. After curing there is a layer of cured, flexible, elastomeric cement bonded between the insert 28 and the interior surface of the socket 24 as shown at 34. This bond has great strength and permits the stretching of the gasket body without rupturing under normal circumstances.

In FIG. 1 there is illustrated the frame 36 of an oven which has the perforations 38 punched or drilled at the corners of the face adjacent the entrance 40 of the oven chamber 42. The gaskets are installed by stretching them somewhat and hooking the hooked ends 32 into these perforations. Removal is accomplished by stretching and withdrawing the hooked ends while the gasket is stretched.

In order to achieve a better bond for holding the insert 28 more tenaciously in the gasket socket 24, several different means are disclosed herein.

Figure 2:
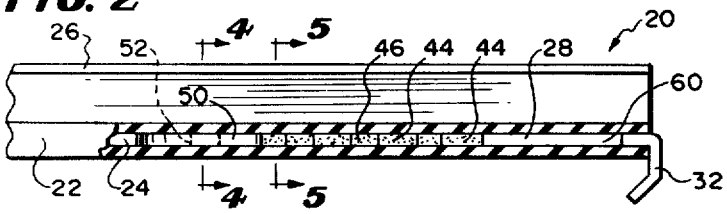
FIG. 2 is a fragmentary sectional view through an oven door stretch gasket showing the construction thereof, the insert being here illustrated in side elevation.
Figure 3:
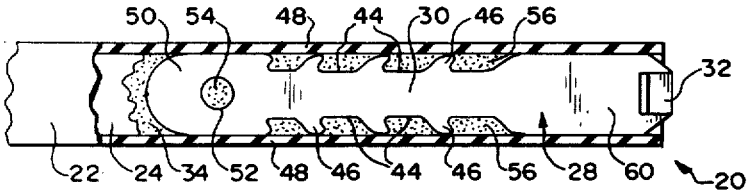
FIG. 3 is a fragmentary bottom plan view of the stretch gasket of FIG. 2 but with the face of the gasket broken away to show the flat profile of the insert.
Figure 4:
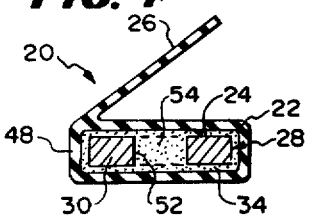
FIG. 4 is a sectional view taken generally along the line 4—4 of FIG. 2 and in the indicated direction.
Figure 5:
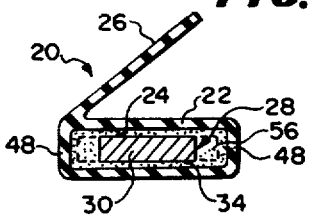
FIG. 5 is a sectional view taken generally along the line 5—5 of FIG. 2 and in the indicated direction.

In FIGS. 1 through 5, the insert 28 has a plurality of lateral notches 44 formed along its edges which produces the teeth or projections 46 between the notches defining wings. These projections or wings 46 extend fully to the interior edges of the rectangular cross section of the socket 24 to fill the same and are rounded so as not to pierce the walls 48 of the tubular member 22. The body 30 has a forward pilot end 50 which is preferably rounded to facilitate introducing the same into the end of the gasket socket 24 and may have a large central perforation 52 as shown in FIGS. 2, 3 and 4 to assist in establishing a good bond of cured RTV cement between the body 22 and the insert 28. Such a bond is shown in the perforation 52 at 54. The RTV cement while in liquid state will normally fill the notches 44 as shown at 56 and form additional bonds to hold the insert 28 in place.

Preferably the wings 46 are canted toward the entrance of the socket 24, that is to the right as viewed in FIGS. 2 and 3, to give additional resistace to pull-out tension when the gasket 20 is stretched. This is effected by punching the notches 44 in suitable configuration as shown. The apperance of the insert 28 in the flat as viewed in FIG. 3 is somewhat like a form of herringbone.

The inserts 28 are best installed into both ends of the gasket body 22 simultaneously when the usual extruded body is used so that the air in the center of the body is confined and tends to force the RTV cement to flow back over the surface of the insert 28 as the insert is pushed home. A plain end section 60 is provided at the hooked end of the insert 28 to serve as a plug preventing the extrusion of the RTV cement during installation, to provide for easy holding during installation, to stiffen the free ends of the gasket and to strengthen the connection of the hooked part 32 where it joins the insert 28.

Figure 6:
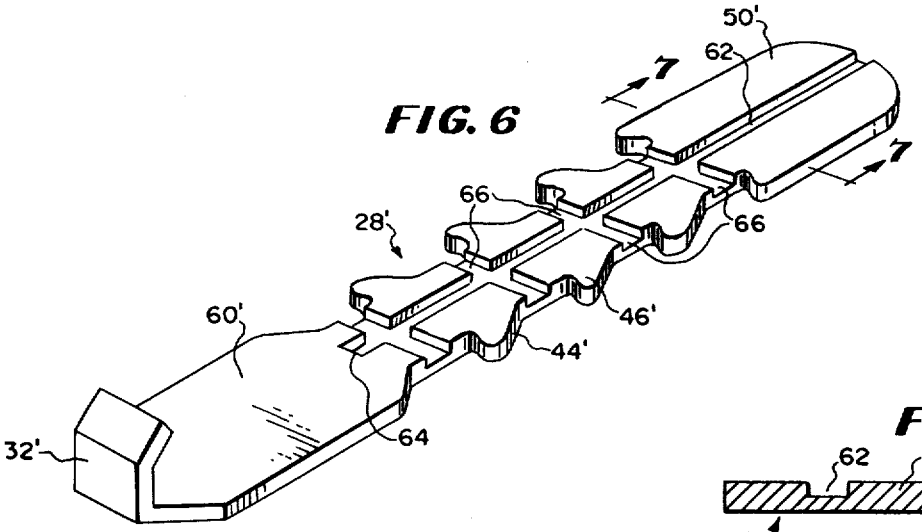
FIG. 6 is a perspective view of an insert of the invention having a modified construction.
Figure 7:
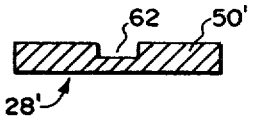
FIG. 7 is a sectional view taken generally along the line 7—7 of FIG. 6 and in the indicated direction.

In FIGS. 6 and 7 there is illustrated an insert 28' whose configuration in the flat is substantially the same as the insert 20. The same reference characters are used to designate the equivalent parts but primed in FIGS. 6 and 7. Thus, there are the same notches 44', protuberances 46', pilot end 50', end section 60' and hooked portion 32'. In this insert 28, there is an elongate groove or channel 62 which starts at the pilot end 50' and terminates at 64 adjacent the end section 60'. The channel 62 has connecting lateral branches 66 which connect with each of the notches 44. When the insert 28' is being installed, the channel 62 and its branches 66 provide passgeways for liquid RTV cement more readily to find its way into the notches 44' for strengthening the bond between the gasket body 22 and the insert 28'. In addition, the channel 62 and its branches 66 provide additional bonding on the surface of the insert 28' by the adherence of the RTV cement which remains in the channel and its branches and the inner surface of the socket 24. A perforation (not shown) like that shown at 52 may be included.

This system of channel and branches may be formed by coining during the punching of the insert 28' from sheet metal or could be cut into the insert as a separate operation. Further, the system may be provided on both faces of the insert 28' or with some of the notches served from one face and the remainder from the other.

Figure 8:
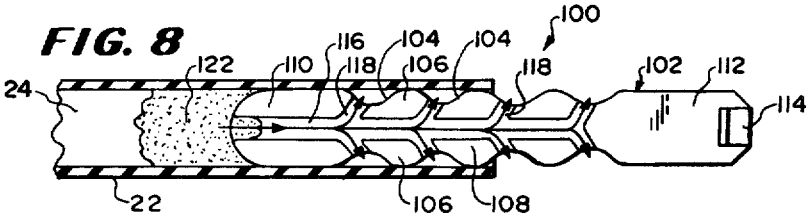
FIG. 8 is a fragmentary sectional view of a stretch gasket similar to the view of FIG. 3 but showing a further modified form of insert in the process of being installed into the gasket end.

FIG. 8 illustrates another modified form of the invention, the gasket here being designated by the reference character 100 and being shown in the process of being formed. The same elastomeric extrusion 22 is used herein, having the center hollow or socket 24 into which an insert 102 is being engaged. The insert 102 in this case has the scalloped edges which are not as sharp as those of the prevously described structures. Thus, the insert 102 has the notches 104 and the protuberances 106. The body is designated generally 108 and there is a pilot end 110 and an end section 112 carrying the hook end 114. There is a central channel 116 and the lateral connecting branches 118 which are angled to make the flow of RTV cement easier. The channel 116 terminates at 120 short of the end of the insert 100.

In FIG. 8, the flow of the RTV cement during installation of the insert 100 is indicated by the arrows. The mass of RTV cement in liquid form is shown at 122 and it will enter the channel system and flow to the notches 104 to provide the tenacious bonding of the invention when it has been cured.

Figure 9:
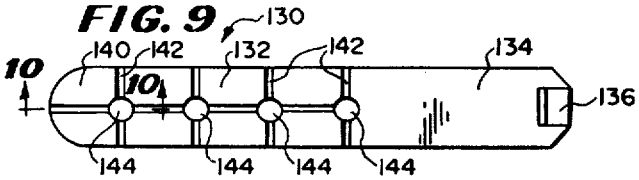
FIG. 9 is a top plan view of still another modified form of insert.

Benefits of the invention may be obtained without the use of the notches, but with the use of the channel system. Thus, in FIGS. 9 and 10 there is illustrated a sheet metal insert 130 which is not notched but has the same width throughout the length of its body 132. Like the other inserts of the drawings, this insert is dimensioned to fit snugly in the hollow socket of an elastomeric length of gasket material. The right hand end 134 has the hook formation 136 that functions in the same manner as those which have been described. A channel system is formed in both the upper and the lower surfaces of the body 132 and in this case the system comprises a main central channel 138 that opens to the pilot end 140 and lateral branches 142. There is a series of perforations at 144 through the body 132 to aid in the passage of the liquid RTV cement to the opposite surfaces of the body 132 and conveniently, the main channel 138 terminates at the right hand perforation 144 and the lateral branches open to the perforations.

Figure 10:
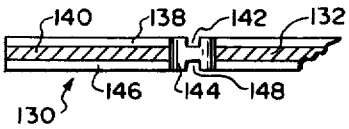
FIG. 10 is a fragmentary sectional view through the insert of FIG. 9.

The same or a similar system may be provided in the opposite face of the body 132. In FIG. 10 can be seen the bottom main channel 146 and one of the lateral branch channels 148.

The channel system aids in the spreading of the RTV cement during the installation of the insert 130 in its socket and the establishment of adhering bonds on the surfaces of the insert between the insert and the walls of the socket 24.

Variations are capable of being made without departing from the spirit or scope of the invention as defined in the claims.

What it is claimed and desired to secure by Letters Patent of the United States is:

1. A gasket for use in connection to an oven for sealing the door and the frame of the oven when the door is engaged to the frame face to face, said gasket comprising:

A. an elongate, hollow elastomeric extruded member with at least the ends providing sockets, B. a pair of relatively short inserts formed from flat strips of metal having top and bottom surfaces and each insert i. having an elongate generally rectangular body with a hook formation at one end thereof, ii. the remainder of the body having its maximum cross section configuration and dimensions such as to fit snugly within one of the sockets, iii. a plurality of lateral notches formed along opposite edges of the body between the ends thereof, and rounded wings separating said notches and defined thereby, said wings extending to the maximum width of the body, iv. and each insert being engaged in one of the respective sockets with only the hook formation protruding, and c. there being a bond of cured RTV adhesive interconnecting the body of each insert with the interior surface of the socket in which it is engaged and including portions of said bond in said notches.

2. The gasket as claimed in claim 1 in which the wings of each insert are arranged on an angle relative to the longer dimension of the body and canted toward the entrance of the socket.

3. The gasket as claimed in claim 1 in which each insert has at least one passageway transversely through the body thereof between its surfaces and the bond extends through the passageway.

4. The gasket as claimed in claim 1 in which the innermost end of the body of each insert has its corners removed and there is an unnotched head formed thereat to be inserted into the socket as a pilot when manufacturing the gasket.

5. The gasket as claimed in claim 4 in which there is a passageway transversely through the body between its surfaces in said unnotched head and the bond extends through said passageway.

6. A gasket for use in connection to an oven for sealing the door and the frame of the oven when the door is engaged to the frame face to face, said gasket comprising:

A. an elongate, hollow elastomeric extruded member with at least the end providing sockets, B. a pair of relatively short inserts formed from flat strips of metal having top and bottom surfaces and each insert i. having an elongate generally rectangular body with a hook formation at one end thereof, ii. the remainder of the body having its maximum cross-section configuration and dimensions such as to fit snugly within one of the sockets, iii. a plurality of lateral notches formed along opposite edges of the body between the ends thereof, and wings separating said notches and defined thereby, said wings extending to the maximum width of the body, iv. a channel system formed on at least one face of the body of each insert which opens to the innermost end of said body and leads to the notches to provide a passageway for flow of the RTV adhesive from the innermost end to the notches during the insertion of the head into a socket during the manufacture of the gasket, v. and each insert being engaged in one of the respective sockets with only the hook formation protruding, and C. there being a bond of cured RTV adhesive interconnecting the body of each insert with the interior surface of the socket in which it is engaged and including portions of said bond in said notches.

7. The gasket as claimed in claim 6 in which the innermost end of the body has its corners removed and there is an unnotched head formed thereat to be inserted into the socket as a pilot when manufacturing the gasket.

8. The gasket as claimed in claim 2 in which the innermost end of the body has its corners removed and there is an unnotched head formed thereat to be inserted into the socket as a pilot when manufacturing the gasket.

9. The gasket as claimed in claim 6 in which the wings are arranged at an angle relative to the longer dimension of the body and canted toward the entrance of the socket.

10. A gasket for use in connection to an oven for sealing the door and the frame of the oven when the door is engaged against the frame of the oven when the door is engaged to the frame face to face, said gasket comprising:

A. an elongate, hollow, elastomeric extruded member with at least the ends providing sockets, B. a pair of relatively short inserts formed from flat strips of metal having top and bottom surfaces and each insert i. having an elongate generally rectangular body with a hook formation at one end thereof, ii. the remainder of the body having its maximum cross section configuration and dimensions such as to fit snugly within one of the sockets, iii. channel means formed in at least one of the surfaces of the body, opening to the front end of the insert which is on the interior of the one socket and said channel means extending to lateral locations on the said one surface iv. each insert being engaged in its respective socket with the hook formation protruding, and C there being a bond of cured RTV adhesive interconnecting the body of each insert with the interior surfaces of the socket in which it is engaged including portions of said bond in said channel means.

11. The gasket as claimed in claim 10 in which said channel means comprise a central channel which terminates short of the hook formation and lateral branches of said main channel extending to the edge of the body.

12. The gasket as claimed in claim 10 in which said body has passageways between the surfaces to provide for bonds of RTV cement between the said surfaces.

13. The gasket as claimed in claim 11 in which said body additionally has notches formed along the side edges thereof and the branches lead to the respective notches.

14. The gasket as claimed in claim 13 in which the channel and branches have a herringbone configuration with the branches canted toward the hooked end of the insert.

* * * * *